United States Patent [19]

Weber

[11] 4,357,880

[45] Nov. 9, 1982

[54] BOLSTER FOR A RAILROAD CAR TRUCK

[75] Inventor: Hans B. Weber, Bedford, Ohio

[73] Assignee: Midland-Ross Corporation, Cleveland, Ohio

[21] Appl. No.: 180,835

[22] Filed: Aug. 25, 1980

[51] Int. Cl.[3] ..... B61F 5/06; B61F 5/12; B61F 5/38

[52] U.S. Cl. ..... 105/206 R; 105/197 R

[58] Field of Search ..... 105/208, 208.1, 208.2, 105/203, 182, 197 R, 179, 206 R

[56] References Cited

U.S. PATENT DOCUMENTS 3,352,255 11/1967 Sheppard ..... 105/206 R
3,670,660 6/1972 Weber et al. ..... 105/206 R
3,924,540 12/1975 Podgajny ..... 105/197 R
4,248,318 2/1981 O'Neil ..... 105/196 R

*Primary Examiner*—Richard A. Bertsch
*Attorney, Agent, or Firm*—Harlan E. Hummer

[57] ABSTRACT

A bolster for a railroad car is described as having larger than normal wedge shoes which necessitate enlarged pockets that reduce the strength of the bolster casting, thereby making it more susceptible to fracturing, unless the high force concentrations in the areas of the pockets are eliminated or substantially reduced. This is accomplished primarily by the removal of portions of the bolster sidewalls between the pockets and outboard lugs for restricting movement of the sideframes longitudinally of the bolsters.

12 Claims, 4 Drawing Figures

BOLSTER FOR A RAILROAD CAR TRUCK

BACKGROUND OF THE INVENTION

The invention is particularly well suited for use in connection with a railroad car bolster wherein the capacity of the dampening mechanism coacting between the sideframes and bolster is increased by enlarging the wedge shoes to increase the wedging surfaces and size of the springs which load the wedge shoes. The larger wedge shoes necessitate increasing the size of the wedge shoe pockets in the bolster by cutting more deeply into the bolster which weakens the bolster and creates higher stresses in the areas of the pockets, thereby making the bolster more susceptible to fatigue and fracturing in these vital areas. The invention is directed to substantially decreasing such stresses so that fatigue and fracturing of the bolster is less likely to occur when larger than normal wedge shoes are used.

Briefly stated, the invention is in an improved bolster having at each opposing end, a pair of pockets for receiving a pair of larger than normal, conventionally shaped wedge shoes used in dampening forces between the bolster and a pair of attached sideframes to which the wheels of the railroad car truck are mounted. The triangularly shaped pockets extend between the top and bottom walls of the bolster and are each located between a pair of projecting lugs that are designed to contain the sideframes on the bolster. A pair of coplanar sidewalls inboard and outboard are located between each pocket and an adjacent pair of lugs and intersect the top wall, the outboard sidewalls being closer the outer free ends of the bolster. The upper portions of the outboard sidewalls, adjacent to top wall of the bolster, are recessed inwardly of the bolster towards the longitudinal axis thereof, so that the sideframes as they rock in vertical planes, will not contact the upper portions of the outboard sidewalls, since contact of the sideframes with the upper portions of the outboard sidewalls produce a twisting action that unduly stresses the decreased sections of the bolster in the enlarged pockets and causes fracturing of the bolster in these areas. Thus, contact between the sideframes and bolster adjacent the top wall of the bolster, is shifted to the sturdier inboard sidewalls of the bolster.

DESCRIPTION OF THE DRAWING

The following description of the invention will be better understood by having reference to the accompanying drawing, wherein.

DETAILED DESCRIPTION OF THE DRAWING

Figure 1:
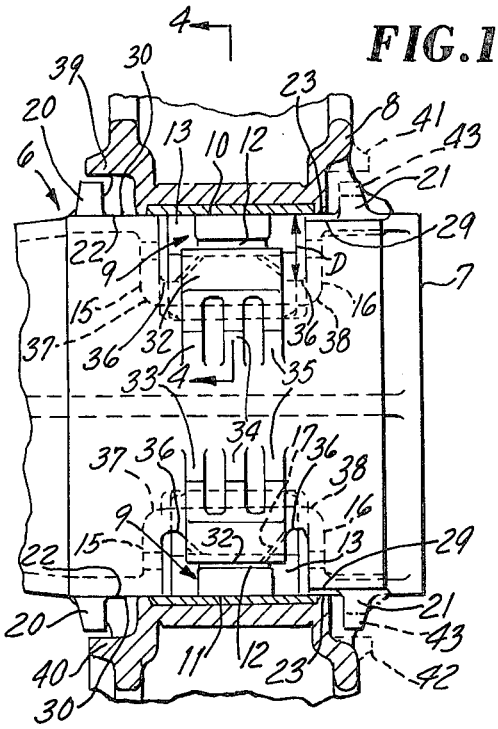
FIG. 1 is a plan view of one of a pair of identical, opposing ends of a bolster which is made in accordance with the invention, this view showing portions of an attached sideframe, in section.
Figure 2:
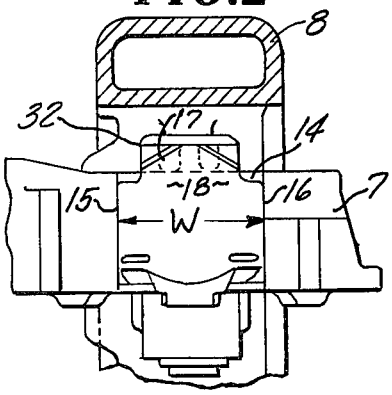
FIG. 2 is a side view of the bolster end with portions of the sideframe removed.

With reference to the drawing, there is shown a bolster 6 which, for descriptive purposes, is assumed to be in a horizontal position as it would be if it were pivotally mounted on the underside of a railroad car and attached to a railroad car truck that is resting on a pair of horizontal rails. The bolster 6 has a pair of identical, opposing free ends 7 which are equally spaced from the point of attachment of the bolster to the underside of the railroad car. A conventional sideframe 8, designed to rotatably support a pair of flanged wheels, is slidably mounted on the bolster 6 adjacent each of the opposing ends 7 for limited linear and rocking movement in a vertical plane.

A snubber or dampening device 9 is interposed between the bolster 6 and adjacent, parallel vertical columns 10,11 of each of the sideframes 8. Such a device is described in, for example, U.S. Pat. No. 3,670,660. Briefly, each of the dampening devices 9, essentially comprises an upright, triangularly shaped pocket 12 which is formed in the bolster 5 and designed to receive a matingly configured generally triangularly configured wedge shoe 13. Each pocket 12 is defined by a rectangular, inclined planar backwall surface 14 which is included between a pair of opposing, triangularly shaped sides 15,16. A flat, rectangular, removable wearplate 17 with chipped corners is secured to the inclined backwall surface 14 of each of the pockets 12 and has an outer bearing surface 18 that slidably and rockingly engages an adjacent curved wedging surface 19 on each of the wedge shoes 13. Each of the pockets 12 is located between a pair of lugs 20,21 which are spaced longitudinally of the bolster 6 and project from a pair of coplanar inboard and outboard vertical sidewalls 22,23 which are between the lugs 20,21 and each of the pockets 12, the outboard sidewalls 23 being closer the outer free ends 7 of the bolster 6 and farther from the bolsters pivotal connection to the railroad car than the inboard ends 22. The pockets 12 extend between the top and bottom walls 24,25 of the bolster 6. A plurality of coil springs 26,27 are conventionally provided to load the wedge shoes 13.

Figure 3:
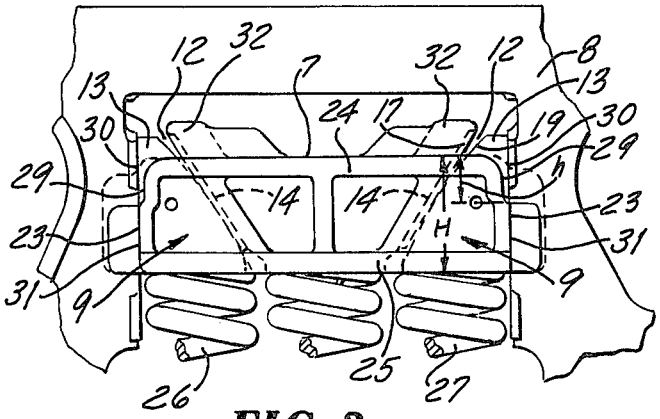
FIG. 3 is an end view of the bolster end and sideframe portions.

An upper portion 29 of each of the vertical outboard sidewalls 23 adjacent the top wall 24, is recessed sufficiently inwardly towards the longitudinal axis of the bolster 6 out of contact with the sideframes 8 as they rock in vertical planes. Thus, a rocking sideframe 8 will, in relation to contacting the bolster 6 adjacent the top wall 24, engage only similar upper portions 30 of the sturdier inboard sidewalls 22 of the bolster 6 to eliminate the twisting forces which the rocking sideframes 8, would normally create against the weakened sections of the enlarged pockets 12, if allowed to contact the upper portions 29 of the outboard sidewalls 23. It can be appreciated that a rocking sideframe 8 will contact only the lower portions 31 of the outboard sidewalls 23. As seen in FIG. 3, the vertically measured height h of the upper recessed portions 29 of the outboard sidewalls 23 is $\frac{1}{3}$–$\frac{1}{2}$ the overall height H of the outboard sidewalls 23, including the lower portions 31 thereof.

This problem of high stress, as indicated above, is especially true when the pockets 12 are increased from a normal width W, for example, of $5\frac{3}{4}$ inches to $6\frac{3}{4}$ inches, and from a conventional depth D, measured at the top wall 24, of less than 1 inch to $1\frac{1}{2}$ inches. It can be appreciated that enlarging the pockets 12 to accommodate bigger wedge shoes 13, even these relatively small amounts, critically decreases the cross-sectional areas of the bolster 6 in the pockets 12. The aforementioned improvement of recessing the upper portions 29 of the outboard sidewalls has proven successful in substantially reducing the stresses which are imparted to the bolster 6 in these critical areas of the enlarged pockets 12.

Figure 4:
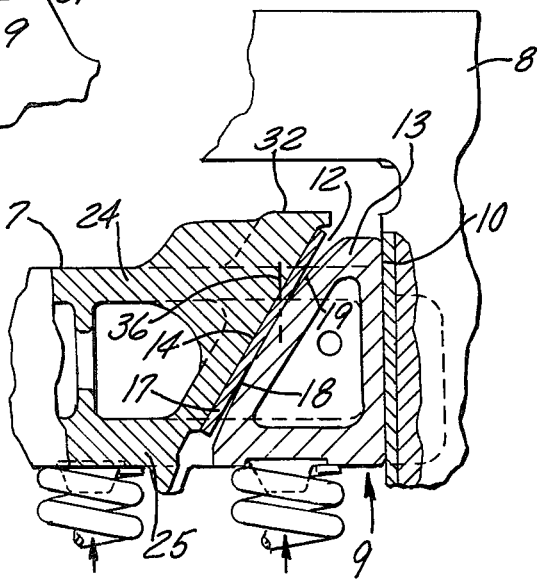
FIG. 4 is a section viewed from the line 4—4 of FIG. 1.

With particular reference to FIG. 4, the wearplate 17 is secured to a hood 32 which extends above the top wall 24 and is provided adjacent each of the pockets 12 as a means of extending the inclined outer bearing surface 18 of the wearplate 17 above the top wall 24 of the bolster 6. The hoods 32 are each reinforced by three parallel ribs 33–35 which extend longitudinally of the bolster 6. Some bolster designs have removed the top wall 24 under the hood 32. However, it has been found beneficial to maintain the top wall 24 solid under the hood 32 as a means of further reducing high stress concentrations in the areas of the enlarged pockets 12. The outer free edges 36 (FIG. 4) of the top wall 24 on either side of the hood 32 are deliberately blunted and provided with a vertically extending flat face measuring $\frac{3}{8}$ to $\frac{1}{2}$ inches to further reduce stress buildup which can result, if the outer free edges 36 of the top wall 24 are pointed, as can be imagined from FIG. 4.

The sloped back wall surface 14 of each pocket 12 is normally provided with a recess or concave channel along either side of the wearplate 17 to prevent improper seating of the wearplate 17 against the surface 14 caused, for example, by debris which can accumulate adjacent the inside rounded corners of the pockets 12 during the casting operation. These particular recesses are eliminated, and the radius of curvature of the inside rounded corners 37,38 of each pocket 12 between the back wall surface 14 and triangular sides 15,16 is increased from, for example, 3/16 inches to $\frac{1}{2}$ inches to strengthen the pockets 12 in these areas to further reduce high stress concentrations in the critical areas of the pockets 12. In such instances, the wearplates 17 are reduced, in width, to insure their proper seating within the pockets 12 by the allowance of more space alongside for any debris that may accumulate in the corners during the casting operation.

Thus, there has been provided a number of ways in which high stress concentrations occurring in enlarged pockets for receiving larger than normal friction wedge shoes, can be substantially reduced to prevent fatigue and fracturing of the bolster, the primary improvement being in the specially recessed upper portions of the outboard sidewalls of the bolster between the pockets and the outer guide lugs or gibs to prevent contact of a rocking sideframe with the bolster in this area, since such contact produces a severe twisting action which normally creates high stresses in the critically reduced sections of the pockets adjacent the top wall 24 of the bolster. The recessing of the upper portions of the outboard sidewalls also eliminates the high stresses normally produced in the bolster pockets adjacent the top wall 24 during lozening or parallelograming of the truck, since the sideframes contact the lower, and not upper portions of the outboard sidewalls of the bolster. Thus, the stresses normally concentrating in the pockets near the top wall of the bolster and produced by the rotation of the sideframes and lozening of the trucks, are eliminated or substantially reduced, thereby leaving only the stresses produced in these areas of the pockets by the spring forces acting directly upon the bolster or indirectly upon the bolster via the wedges.

With reference to FIG. 1, each of the sideframes 8 may be provided with at least a pair of inboard anti-rotation lugs 39,40 which are designed to engage the adjacent inboard guide lugs or bolster gibs 20 to restrict rotation and parallelograming of the sideframes. If a set of outboard anti-rotation lugs 41,42 are used, then similar upper portions 43 of the outboard gibs 21 may be removed or recessed, similar to the upper portions 29 of the outboard sidewalls 23, so that any engagement between the outboard bolster gibs 21 and anti-rotation lugs 41,42 occurs in the lower, and not upper portions, of the bolster where the aforementioned stresses normally congregate. This is especially important where the pockets are sufficiently wide to extend substantially between the inboard and outboard lugs or gibs 20,21 to practically eliminate the inboard and outboard sidewalls 22,23. Thus, the invention of removing portions of the bolster contacted by the sideframes in high stress areas of the bolster, is applicable to both the outboard sidewalls and gibs in instances where a set of outboard anti-rotation lugs are used.

What is claimed is:

1. A bolster for a railroad car truck, comprising:

(a) a pair of pockets recessed inwardly of the bolster towards each other adjacent each one of a pair of opposing outer free ends of the bolster, the pockets extending between a pair of vertically spaced top and bottom walls of the bolster when the bolster is in a normal horizontal position for supporting sideframes of the truck;

(b) a pair of lugs projecting outwardly of the bolster and sandwiching each of the pockets therebetween and designed to restrict movement of the sideframes longitudinally of the bolsters;

(c) a pair of coplanar inboard and outboard sidewalls extending from the top wall between each pocket and an adjacent pair of lugs which sandwich the pocket therebetween, the outboard sidewalls being closer the outer free ends of the bolster than the inboard sidewalls, the outboard sidewalls each having an upper portion thereof which is adjacent the top wall of the bolster and a lower portion thereof which is adjacent the bottom wall of the bolster; and (d) means for maintaining a sideframe, rocking in a generally vertical plane, free of the upper portions of the outboard sidewalls, so that a rocking sideframe will contact the lower rather than the upper portions of the outboard walls, said means including outboard sidewalls wherein the upper portions thereof are recessed inwardly towards the longitudinal axis of the bolster a distance sufficient to keep a rocking sideframe from contacting the bolster in this area.

2. The bolster of claim 1, wherein each pocket includes:

(I) a hood extending above the top wall of the bolster, the hood having an outer inclined surface which is aligned with an outer inclined surface of the pocket between the top and bottom walls; and (II) a replaceable wearplate secured to the inclined surfaces.

3. The bolster of claim 2, wherein each hood is reinforced by at least three ribs which extend from the top wall in directions away from the bolster, the ribs extending longitudinally of the bolster.

4. The bolster of claim 1, wherein the top wall is solid and free of openings therein adjacent the inclined surfaces of each hood.

5. The bolster of claim 4, wherein outer faces of the top wall on either side of a hood, are blunted and have flat faces which are about $\frac{1}{2}$ inches high measured from an outer surface of the top wall in a plane which is normal to the longitudinal axis of the bolster.

6. The bolster of claims 1, 3 or 5, wherein the inclined surface of each pocket is included between a pair of generally triangularly shaped, parallel sides, the plane of the sides intersecting the planes of the inclined surfaces, and a curved surface is between each one of a pair of the triangularly shaped sidewalls and included inclined surface, the curved surfaces each having a radius of curvature of about ½ inches.

7. The bolster of claims 1, 3 or 5 wherein the lugs between the outboard sidewalls and outer free ends of the bolster, each have an upper portion which is closer the top wall than a bottom portion thereof and which is recessed inwardly towards the longitudinal axis of the bolster a distance sufficient to maintain said lugs out of contact with any adjacent anti-rotation lugs carried by a rocking sideframe.

8. A bolster for a railroad car truck, comprising:

(a) a pair of pockets recessed inwardly of the bolster towards each other adjacent each of a pair of opposing outer free ends of the bolster, the pockets extending between a pair of vertically spaced top and bottom walls of the bolster when the bolster is in a normal horizontal position for supporting sideframes of the truck, each pocket having an inclined surface which is included between a pair of generally triangularly shaped sidewalls, a curved surface being formed between the planes of each said pair of parallel sidewalls and said included inclined surface;

(b) a pair of lugs projecting inwardly of the bolster and sandwiching each of the pockets therebetween and designed to restrict movement of the sideframes longitudinally of the bolsters;

(c) a pair of coplanar inboard and outboard sidewalls extending from the top wall between each pocket and an adjacent pair of lugs which sandwich the pocket therebetween, the outboard sidewalls being closer the outer free ends of the bolster than the inboard sidewalls, the outboard sidewalls each having an upper portion thereof, adjacent the top wall of the bolster, recessed inwardly of the bolster towards the longitudinal axis thereof a distance sufficient so that a sideframe, rocking in a generally vertical plane, will be free of the upper portions and contact similar upper portions of the inboard sidewalls rather than those of the outboard sidewalls;

(d) a hood projecting from the top wall of the bolster adjacent each pocket, each hood having an inclined surface aligned with the inclined surface of an adjacent pocket, the top wall being solid in the areas of the hood;

(e) a pair of replaceable wearplates secured to the aligned, inclined surface of the hoods and pockets in spaced relation from the triangularly shaped sidewalls of the pockets; and (f) the top wall of the bolster on either side of each hood being blunted and having a flat face which confronts an adjacent column of a sideframe.

9. The bolster of claim 8, which includes at least three ribs projecting from the top wall for reinforcing each of the hoods, the ribs extending longitudinally of the bolster.

10. The bolster of claim 9, wherein the lugs between the outboard sidewalls and outer free ends of the bolster, each have an upper portion which is closer the top wall than a bottom portion thereof and which is recessed inwardly towards the longitudinal axis of the bolster a distance sufficient to maintain said lugs out of contact with any adjacent anti-rotation lugs carried by a rocking sideframe.

11. A bolster for a railroad car truck, comprising:

(a) a pair of wedge pockets recessed inwardly towards each other in the bolster adjacent each one of a pair of opposing outer free ends of the bolster, the wedge pockets extending between top and bottom walls of the bolster when the bolster is in a horizontal position where the pockets are vertically disposed; and (b) a pair of inboard and outboard bolster gibs sandwiching each pocket therebetween and extending from the bolster so that free outer ends of the gibs are spaced from the bolster, the outboard gibs being closer the outer free ends of the bolster than the inboard gibs and having upper portions of their free outer ends recessed inwardly towards the longitudinal axis of the bolster a distance sufficient to maintain the upper portions free of contact with adjacent outboard anti-rotation lugs carried by a sideframe when the sideframe is caused to rock in a plane which is angularly disposed to the longitudinal axis of the bolster.

12. The bolster of claim 11, which includes an outboard sidewall disposed between each pocket and adjacent outboard gib, the outboard sidewall having an upper portion, adjacent the top wall, which is recessed inwardly towards the longitudinal axis of the bolster a distance sufficient to maintain the upper portions of the outboard sidewalls free of contact with a rocking sideframe.

* * * * *